US010400651B2

(12) United States Patent
Hikichi

(10) Patent No.: US 10,400,651 B2
(45) Date of Patent: Sep. 3, 2019

(54) EXHAUST GAS PURIFICATION DEVICE FOR INTERNAL COMBUSTION ENGINE

(71) Applicant: HONDA MOTOR CO., LTD., Tokyo (JP)

(72) Inventor: Kentaro Hikichi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 80 days.

(21) Appl. No.: 15/538,472

(22) PCT Filed: Dec. 22, 2015

(86) PCT No.: PCT/JP2015/085844

§ 371 (c)(1),
(2) Date: Jun. 21, 2017

(87) PCT Pub. No.: WO2016/104508

PCT Pub. Date: Jun. 30, 2016

(65) Prior Publication Data

US 2017/0335735 A1 Nov. 23, 2017

(30) Foreign Application Priority Data

Dec. 25, 2014 (JP) ..... 2014-262391

(51) Int. Cl.
*F01N 3/26* (2006.01)
*F01N 13/18* (2010.01)

(52) U.S. Cl.
CPC ..... *F01N 3/26* (2013.01); *F01N 13/18* (2013.01); *F01N 2260/18* (2013.01); *F01N 2260/20* (2013.01)

(58) Field of Classification Search
CPC ... F01N 3/26; F01N 3/28; F01N 13/18; F01N 2260/18; F01N 2260/20
(Continued)

(56) References Cited

U.S. PATENT DOCUMENTS

2005/0051383 A1 3/2005 Harwood
2005/0193726 A1 9/2005 Funakoshi
(Continued)

FOREIGN PATENT DOCUMENTS

AU 2008207497 A1 3/2009
CA 2414160 A1 * 6/2004 ..... F01N 13/102
(Continued)

OTHER PUBLICATIONS

International Search Report dated Feb. 9, 2016, issued in counterpart International Application No. PCT/JP2015/085844 (3 pages).
(Continued)

*Primary Examiner* — Ngoc T Nguyen
(74) *Attorney, Agent, or Firm* — Westerman, Hattori, Daniels & Adrian, LLP

(57) ABSTRACT

Provided is an exhaust gas purification device provided with a cover which can reduce radiated noise at low cost without impairing the heat shield function of the cover. Provided is an exhaust gas purification device comprising: an exhaust gas purification device body provided to the exhaust pipe of a diesel engine and purifying exhaust gas; and a substantially rectangular cover provided so as to cover at least a part of the exhaust gas purification device body and blocking heat radiated from the exhaust gas purification device body. The cover is provided with a plurality of protruding ribs formed on the surface thereof. The ribs comprise: radial ribs formed extending radially from a center section centered at the intersection of the diagonals of the cover; and a circumferential rib formed continuously along the entire circumference of a circle centered at the intersection.

4 Claims, 9 Drawing Sheets

(58) Field of Classification Search
USPC ..... 60/605.1
See application file for complete search history.

(56) References Cited

U.S. PATENT DOCUMENTS

| | | | |
|---|---|---|---|
| 2008/0292832 | A1 | 11/2008 | Zika-Beyerlein et al. |
| 2016/0319728 | A1* | 11/2016 | Jenison ..... F01N 13/002 |

FOREIGN PATENT DOCUMENTS

| | | | |
|---|---|---|---|
| CN | 103206289 | A | 7/2013 |
| CN | 103486233 | A | 1/2014 |
| JP | 58-4738 | U | 1/1983 |
| JP | 58-20319 | U | 2/1983 |
| JP | 63-9444 | U | 1/1988 |
| JP | 5-332135 | A | 12/1993 |
| JP | 8-82223 | A | 3/1996 |
| JP | 2002-138812 | A | 5/2002 |
| JP | 2002-161739 | A | 6/2002 |
| JP | 2005-83376 | A | 3/2005 |
| JP | 2005-248778 | A | 9/2005 |
| JP | 4094423 | B2 | 6/2008 |
| JP | 2009-52441 | A | 3/2009 |
| JP | 2011-156592 | A | 8/2011 |

OTHER PUBLICATIONS

Office Action dated Nov. 5, 2018, issued in counterpart Chinese Application No. 201580069530.4. (6 pages).

* cited by examiner

EXHAUST GAS PURIFICATION DEVICE FOR INTERNAL COMBUSTION ENGINE

TECHNICAL FIELD

The present invention relates to an exhaust gas purification device for an internal combustion engine. In detail, it relates to an exhaust gas purification device for an internal combustion engine including a cover for shielding radiated heat from the exhaust gas purification device.

BACKGROUND ART

Conventionally, in order to avoid the thermal effect on peripheral components due to radiated heat from the exhaust gas purification device main body for an internal combustion engine, an exhaust gas purification device including a cover for shielding has been known. This cover for shielding shields radiated heat from the exhaust gas purification device main body by covering at least part of the exhaust gas purification device main body.

However, the above-mentioned cover for shielding is provided to contact the exhaust gas purification device main body; therefore, it may generate sound radiation by amplifying the vibration of the exhaust system, and negatively affect the NVH of a motor vehicle. For this reason, technology providing holes in the cover for shielding (for example, refer to Patent Document 1), and technology providing convex ribs to the surface of the cover for shielding (for example, refer to Patent Document 2) have been disclosed, for example.

Patent Document 1: Japanese Patent No. 4094423

Patent Document 2: Japanese Unexamined Patent Application, Publication No. 2002-161739

DISCLOSURE OF THE INVENTION

Problems to be Solved by the Invention

However, with the technology providing holes in the cover as in Patent Document 1, since the shielding function which is the original function of the cover is impaired, and machining for drilling is necessary, there is a problem in that the manufacturing costs increase. In addition, with the technology providing convex ribs to the cover as in Patent Document 2, although low-cost manufacturing is possible by press working, the current situation is that it has not been possible to sufficiently reduce noise radiation.

The present invention has been made taking account of the above, and the object thereof is to provide an exhaust gas purification device including a cover that can reduce radiated noise at low cost without impairing the heating shield function.

Means for Solving the Problems

In order to achieve the above-mentioned object, the present invention provides an exhaust gas purification device (for example, the exhaust gas purification device 1 described later) for an internal combustion engine that includes: an exhaust gas purification device main body (for example, the exhaust gas purification device main body 10 described later) that is provided in an exhaust channel (for example, the exhaust pipe 9 described later) of the internal combustion engine, and purifies exhaust gas of the internal combustion engine; and a cover (for example, the cover 2 described later) of quadrate shape that is provided so as to cover at least part of the exhaust gas purification device main body, and shields radiated heat from the exhaust gas purification device main body, in which the cover has a plurality of convex ribs (for example, the convex ribs 20 described later) formed on the surface thereof, and the ribs include a radial rib (for example, the radial rib 21, top and bottom radial ribs 21*a*, 21*a*, left and right radial ribs 21*b*, 21*b*, right oblique radial ribs 21*c*, 21*c*, and left oblique radial ribs 21*d*, 21*d* described later) formed radially from a central part with a point of intersection of diagonal lines of the cover as the center, and a circumferential rib (for example, the circumferential rib 22 described later) formed continuously over the entire circumference of a circle with the point of intersection as the center.

In the present invention a plurality of convex ribs are formed on the surface of the cover of quadrate shape. More specifically, the radial ribs which extend radially from the central part with the point of intersection of diagonal lines of the cover as the center, and circumferential ribs which continuously extend along the entire circumference of a circle with the point of intersection of diagonals of the cover as the center are formed. According to the present invention, since the radial ribs come to be formed to crowd in the vicinity of the central part of the cover, it is possible to reduce the vibrations in the vicinity of the central part of the cover by way of these radial ribs. In addition, since the circumferential ribs come to divide the vicinity of the outer circumferential part of the cover in addition to the radial ribs, it is possible to reduce the vibrations in the vicinity of the outer circumferential part of the cover by way of these radial ribs and circumferential ribs. Therefore, according to the present invention, it is possible to reliably reduce the radiated noise (whirl noise) generated from the cover. In addition, according to the present invention, since there is no requirement to form holes, the heat shielding function will not be impaired. Furthermore, the radial ribs and circumferential ribs are integrally molded with the cover by press working, and thus can be produced at low cost.

It is preferable for a turbine (for example, the turbine 81 described later) of a turbocharger (for example, the turbocharger 8 described later) that compresses intake air using energy of exhaust gas to be provided in the exhaust channel, and the exhaust gas purification device main body to be provided in a vicinity of the turbine.

With the present invention, the turbine of a turbocharger for compressing intake air using the energy of exhaust gas is provided in the exhaust pipe, and the exhaust gas purification device main body is provided in the vicinity of the turbine. It is thereby possible to reliably reduce the radiated noise (whirl noise) generated remarkably by the whirl vibration of the turbine, and the aforementioned effects are more reliably exhibited.

It is preferable for the central part to be formed by a substantially even, fiat surface.

With the present invention, the central part with the point of intersection of diagonal lines of the cover as the center is formed by a substantially even, fiat surface. By the aforementioned radial ribs being connected at the central part, it is thereby possible to avoid a convex plane from being continually formed, and it is possible to more reliably reduce the radiated noise.

Effects of the Invention

According to the present invention, it is possible to provide an exhaust gas purification device including a cover that can reduce radiated noise at low cost without impairing the heat shielding function.

PREFERRED MODE FOR CARRYING OUT THE INVENTION

Hereinafter, an embodiment of the present invention will be explained in detail while referencing the drawings.

Figure 1:
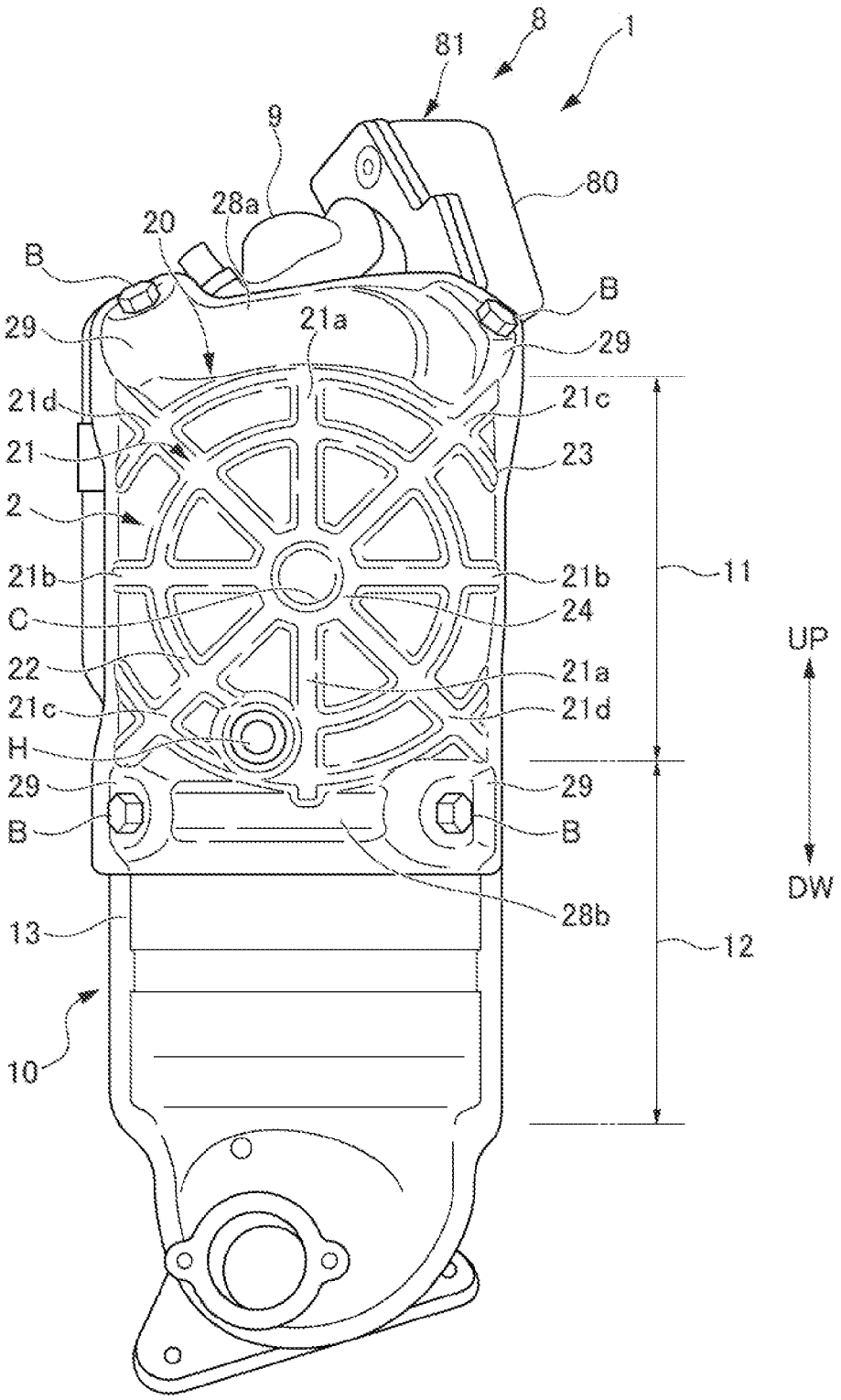
FIG. 1 is a drawing viewing an exhaust gas purification device for an internal combustion engine according to an embodiment of the present invention from a vehicle forward side.

FIG. 1 is a drawing viewing an exhaust gas purification device 1 for an internal combustion engine according to an embodiment of the present invention from a vehicle forward side. The exhaust gas purification device 1 according to the present embodiment is arranged at a vehicle forward side of a diesel engine which directly injects fuel into the combustion chamber of each cylinder (not illustrated). More specifically, the exhaust gas purification device 1 is provided to an exhaust pipe 9 which extends downwards along a lateral face on a vehicle forward side, directly under the diesel engine, in a state orientating the flow direction of exhaust gas to downwards. This exhaust gas purification device 1 purifies NOx, CO and HC within exhaust gas, as well as purifying particulate matter (hereinafter referred to as "PM") within the exhaust gas.

A turbine 81 constituting a turbocharger 8 is provided on an upstream side of the exhaust pipe 9. In other words, an exhaust gas purification device main body 10 is provided in the vicinity (directly below) the turbine 81. The turbine 81 is accommodated within a turbine housing 80, and is rotationally driven by the kinetic energy of exhaust gas flowing through the exhaust pipe 9. Intake air is compressed by a compressor provided in the intake plumbing (not illustrated) being rotationally driven by way of the rotational driving of this turbine 81. The turbine 81 generates radiated noise (whirling noise) by way of a whirling vibration, and becomes the main cause of noise. The generation of whirling noise by this turbine 81 will be described in detail later.

As shown in FIG. 1, the exhaust gas purification device 1 includes the exhaust gas purification device main body 10 and a cover 2.

The exhaust gas purification device main body 10 includes an exhaust gas purification catalyst part 11 arranged at an upstream side, a DPF (diesel particulate filter) 12 arranged at a downstream side, and a single case member 13 that stores this exhaust gas purification catalyst part 11 and DPF 12. In other words, the exhaust gas purification catalyst part 11 and DPF 12 are arranged adjacently to each other within the single case member 13.

The exhaust gas purification catalyst part 11 purifies NOx, CO and HC within the exhaust gas. The exhaust gas purification catalyst part 11 is configured from a honeycomb substrate on which an exhaust gas purification catalyst is loaded, and is stored within the case member 13 via a retaining mat (not illustrated). The honeycomb substrate is a flow-through type honeycomb substrate formed in a columnar shape with a substantially circular cross-section. As the material of the honeycomb substrate, cordierite, alumina titanate or mullite can be exemplified. As the exhaust gas purification catalyst, an oxidation catalyst or NOx catalyst such as a NOx storage catalyst (LNC) is used. For example, at least one noble metal among Pt, Pd and Rd, zeolite, Ba and Ce are contained. NOx, CO and HC within the exhaust gas are purified by this exhaust gas purification catalyst.

The DPF 12 collects PM within the exhaust gas. The DPF 12 is configured from a filter on which PM combustion catalyst is loaded, and is stored within the case member 13 via a retaining mat (not illustrated). The filter is a wall-flow type filter formed in a columnar shape with a substantially circular cross-section. As the material of the filter, silicon carbide (SiC), cordierite, alumina titanate or mullite can be exemplified. The PM combustion catalyst is loaded substantially uniformly on the entirety of the filter, whereby PM collected by the filter is combustively removed. As the PM combustion catalyst, for example, one containing Ag and at least one noble metal among Pt and Pd is used. This Ag-based PM combustion catalyst has the most superior PM oxidation performance, as well as being able to oxidatively purify PM from lower temperatures than other PM combustion catalysts.

The case member 13 is substantially cylindrical with a substantially annular cross-section, and accommodates the exhaust gas purification catalyst part 11 and DPF 12 as mentioned above. Herein, a circular ring, elliptical ring and annular shape having a plurality of arcs are included by substantially annular shape. The case member 13 is configured from metal such as SITS. The case member 13 is a clam shell-type case member configured from two case halves divided in two in the circumferential direction along the central axis line. The case member 13 is formed by butt welding these two case halves to form one body.

The cover 2 is provided so as to cover the vehicle forward side of the exhaust gas purification device main body 10, and shields heat dissipation from the exhaust gas purification device main body 10. In more detail, the cover 2 is provided so as to cover the vehicle forward side of an upstream side portion of the exhaust gas purification device main body 10 in which the exhaust gas purification catalyst part 11 is stored. The cover 2 gently bends along the outer circumferential side shape of the substantially cylindrical case member 13, and is formed by a plate member of substantially rectangular shape consisting of metal such as SUS.

The cover 2 has fastening parts 29 of convex shape at the four corners thereof. By bolts B being fastened to these fastening parts 29 at the four corners, the cover 2 is fixed to the case member 13. The cover 2 has, at the upper end thereof, an upper end swelling part 28*a* that swells from the surface of the cover 2, and connects two fastening parts 29 at the upper end. Similarly, the cover 2 has, at the lower end thereof, a lower end swelling part 28*b* that swells from the surface of the cover 2, and connects two fastening parts 29 at the lower end. In addition, a sensor mounting hole H for mounting the exhaust gas sensor is inevitably formed, similarly to conventionally, in the surface of the cover 2.

The cover 2 suppresses whirl vibration generating from the aforementioned turbine 81, and has a shape that can reduce the whirl noise. Herein, the generation mechanism of whirl noise generating from the turbine 81 will be explained prior to explaining the shape of the cover 2. First, in the turbine 81, excitation force generates from the rotational energy of the turbine 81. When this happens, this excitation force is transmitted to the bearings, and the bearings vibrate. Next, this vibration of the bearings is transmitted to the turbine housing 80 via a location pin supporting the turbine 81. The turbine housing 80 thereby starts to vibrate, and the whirl vibration generates. This whirl vibration is transmitted to the exhaust purification device main body 10 and cover 2. The frequency of this whirl vibration is 600 to 800 Hz, and this frequency band is an unpleasant frequency band for humans that is offensive to the ears.

Figure 2:
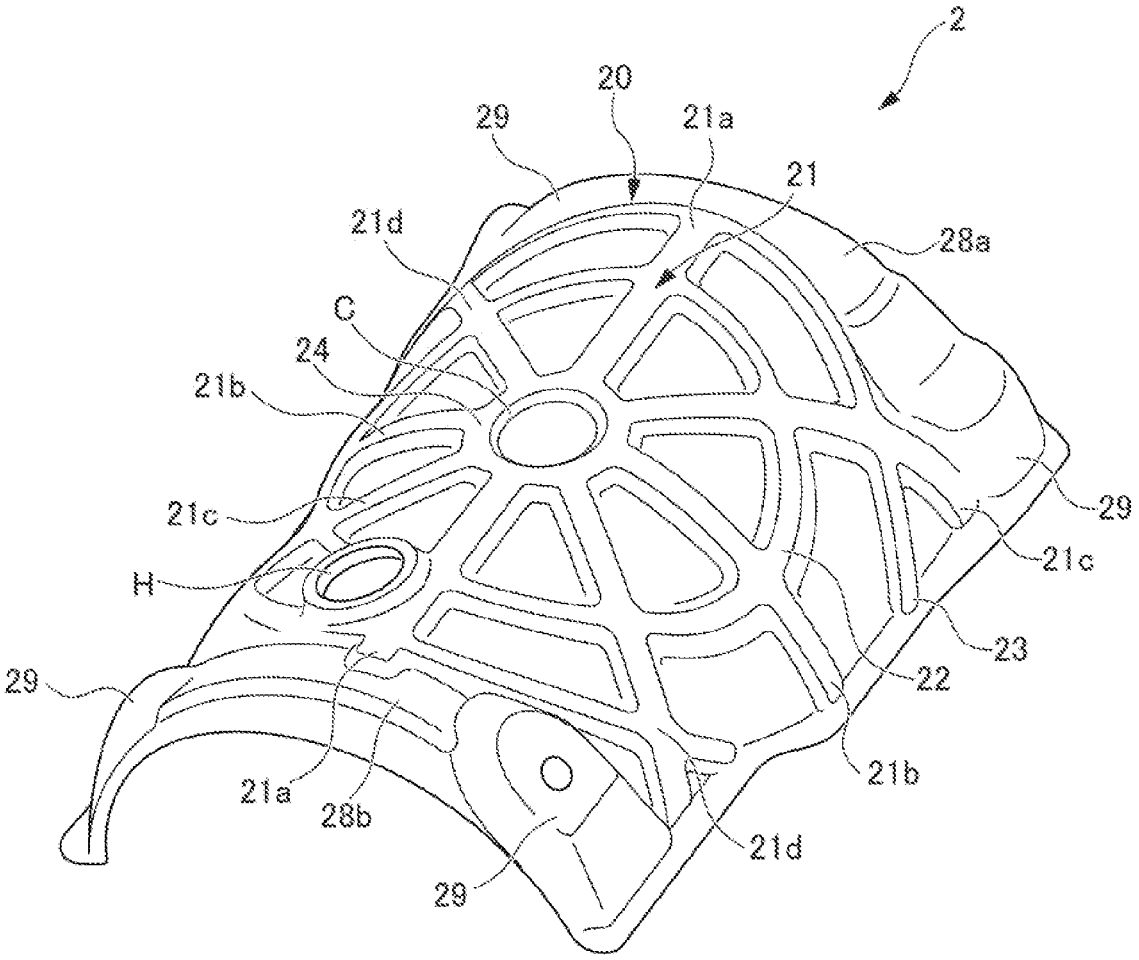
FIG. 2 is a perspective view of a cover of the exhaust gas purification device according to the embodiment.
Figure 3:
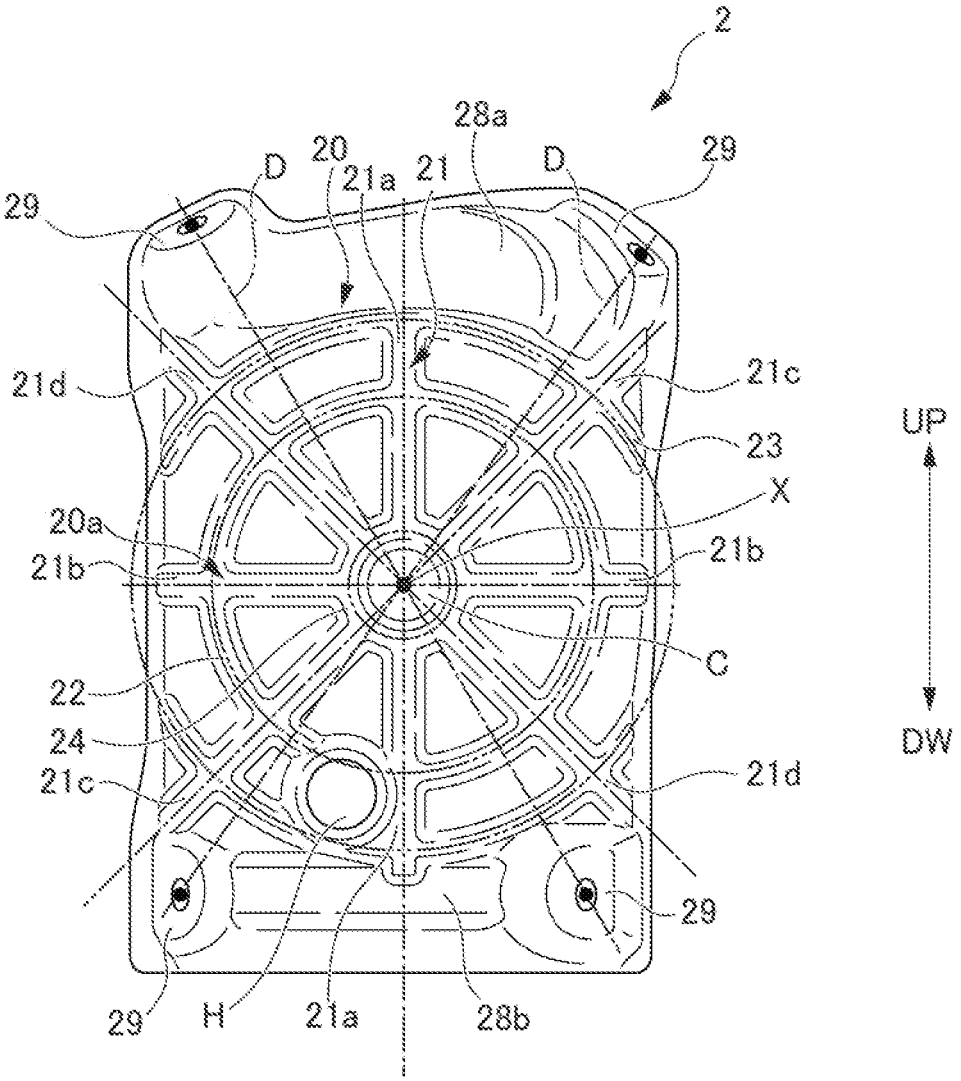
FIG. 3 is a plan view of the cover of the exhaust gas purification device according to the embodiment.

Next, the shape of the cover 2 will be explained in detail while referencing FIGS. 1 to 3. Herein, FIG. 2 is a perspective view of the cover 2, and FIG. 3 is a plan view of the cover 2. As shown in FIGS. 1 to 3, the cover 2 has a plurality of convex ribs 20 formed in the surface thereof. These convex ribs 20 are formed over the entire surface in a range excluding the upper end and lower end of the cover 2 at which the aforementioned upper end swelling part 28*a* and lower end swelling part 28*b* are formed.

As shown in FIG. 2, these convex ribs 20 all have ends making an R shape. In other words, the convex rib 20 is formed in a smooth convex shape. This is due to constraints in molding since the convex ribs 20 are integrally molded in the surface of the cover 2 by press working.

As shown in FIGS. 1 to 3, the convex ribs 20 are configured to include radial ribs 21 and circumferential ribs 22. These radial ribs 21 and circumferential ribs 22 have substantially the same height. By these radial ribs 21 and circumferential ribs 22 joining with each other, a connected substantially flat rib surface 20*a* is formed.

The radial ribs 21 are formed to extend radially from a central part C with the point of intersection X of diagonal lines D formed by linking the fastening parts 29 arranged on diagonals as the center (refer to FIG. 3). More specifically, a total of eight of the radial ribs 21 are formed at intervals of about 45 degrees. In other words, the radial ribs 21 are configured to include top and bottom radial ribs 21*a*, 21*b* which extend from the central part C in vertical up and down directions, left and right radial ribs 21*b*, 21*b* which extend from the central part C in horizontal left and right-directions, right oblique radial ribs 21*c*, 21*c* and left oblique radial ribs 21*d*, 21*d* which extend in oblique left and right directions from the central part C at positions at equal intervals from these top and bottom radial ribs 21*a*, 21*a* and left and right radial ribs 21*b*, 21*b*.

The circumferential ribs 22 are formed continuously along the entire circumference of a circle with the point of intersection X as the center (refer to FIG. 3). The circumferential ribs 22 are formed at the outer side of a central rib 24 constituting an outer edge of the central part C. It should be noted that, although the outer circumferential rib 23 formed more to the outside than the circumferential rib 22 is formed on a circumference with the point of intersection X as the center, since the left and right ends thereof are not continuous and are interrupted, it does not constitute a circumferential rib of the present embodiment.

As shown in FIGS. 1 to 3, the width of each radial rib 21 is substantially equal, and the width of each circumferential rib 22 is substantially equal. However, the width of the radial rib 21 is set to be larger than the width of the circumferential rib 22. In addition, the central part C is formed by a substantially even flat surface. The radial ribs 21 are divided by the central part C formed in this flat plane, and a convex plane that is continuously formed is avoided.

According to the present embodiment possessing the above configuration, the following effects are exerted. In the present embodiment, a plurality of convex ribs 20 is formed on the surface of the substantially rectangular cover 2. More specifically, the radial ribs 21 (top and bottom radial ribs 21*a*, 21*a*, left and right radial ribs 21*b*, 21*b*, oblique right radial ribs 21*c*, 21*c*, oblique left radial ribs 21*d*, 21*d*) which extend radially from the central part C with the point of intersection X of diagonal lines D of the cover 2 as the center, and circumferential ribs 22 which continuously extend along the entire circumference of a circle with the point of intersection X of diagonals D of the cover 2 as the center are formed. According to the present embodiment, since the radial ribs 21 come to be formed to crowd in the vicinity of the central part C of the cover 2, it is possible to reduce the vibrations in the vicinity of the central part C of the cover 2 by way of these radial ribs 21. In addition, since the circumferential ribs 22 come to divide the vicinity of the outer circumferential part of the cover 2 in addition to the radial ribs 21, it is possible to reduce the vibrations in the vicinity of the outer circumferential part of the cover 2 by way of these radial ribs 21 and circumferential ribs 22. Therefore, according to the present embodiment, it is possible to reliably reduce the radiated noise (whirl noise) generated from the cover 2. In addition, according to the present embodiment, since there is no requirement to form holes, the heat shielding function will not be impaired. Furthermore, the radial ribs 21 and circumferential ribs 22 are integrally molded with the cover 2 by press working, and thus can be produced at low cost.

In addition, with the present embodiment, the turbine 81 of a turbocharger 8 for compressing intake air using the energy of exhaust gas is provided in the exhaust pipe 9, and the exhaust gas purification device main body 10 is provided in the vicinity of (immediately below) the turbine 81. It is thereby possible to reliably reduce the whirl noise generated remarkably by the whirl vibration of the turbine 81, and the aforementioned effects are more reliably exhibited.

In addition, with the present embodiment, the central part C with the point of intersection X of diagonal lines D of the cover 2 as the center is formed by a substantially even, flat surface. By the aforementioned radial ribs 21 being connected at the central part C, it is thereby possible to avoid a convex plane from being continually formed, and it is possible to more reliably reduce the whirl noise.

It should be noted that the present invention is not to be limited to the above-mentioned embodiment, and that modifications and improvements within a scope that can achieve the object of the present invention are also included in the present invention.

In the above-mentioned embodiment, the exhaust gas purification device of the present invention is applied to a diesel engine; however, it is not limited thereto. For example, the exhaust gas purification device of the present invention may be applied to a gasoline engine.

With the above-mentioned embodiment, the cover is provided so as to cover mainly the vehicle forward side of the upstream side portion of the exhaust gas purification device main body in which the exhaust gas purification catalyst part is stored; however, it is not limited thereto. For example, the cover may be provided so as to cover the entirety of the exhaust gas purification device main body, and the arrangement of the cover is set as appropriate according to the arrangement of peripheral components.

With the above-mentioned embodiment, the circular circumferential ribs are formed on the surface of the cover as the circumferential ribs; however, it is not limited thereto. For example, as the circumferential ribs, quadrilateral or polygon-shaped circumferential ribs may be formed on the surface of the cover.

EXAMPLES

Next, examples of the present invention will be explained; however, the present invention is not to be limited to these examples.

Examples 1-2 and Comparative Examples 1-8

The cover of the above-mentioned embodiment is defined as Example 1, and a cover including the radial ribs and circumferential ribs of the present invention is defined as Example 2. In addition, various covers outside the scope of the present invention which include at least one among the radial rib and circumferential rib of the present invention are defined as Comparative Examples 1 to 8.

Vibration Analysis Evaluation

Vibration analysis was conducted on each cover of Examples 1 and 2 and Comparative Examples 1 to 8 by CAE (Computer Aided Engineering). More specifically, vibration analysis was conducted for 25 points of 5×5 on each cover. The results are shown in FIGS. 4 to 13. It should be noted that plan views and side views of each cover are shown in FIGS. 4 to 13, and t in each graph indicates the thickness (mm) of each cover.

Figure 4:
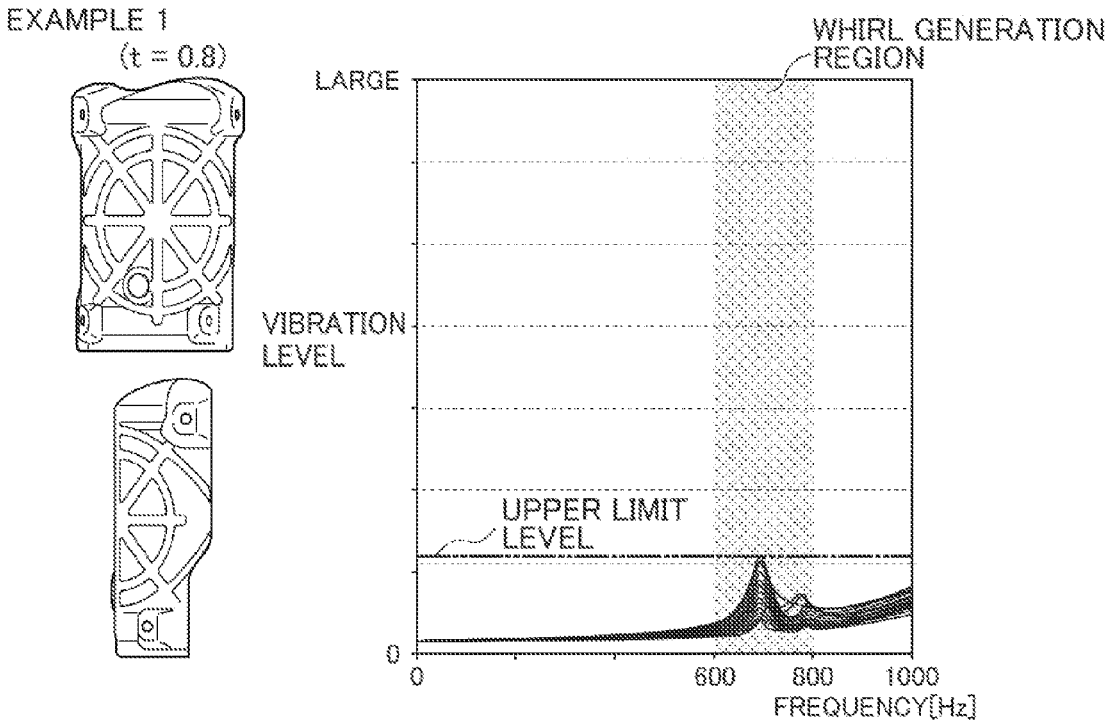
FIG. 4 is a view showing vibration analysis results by CAE of the cover of Example 1.

FIG. 4 is a view showing vibration analysis results by CAE of the cover of Example 1. The shape of the cover of Example 1 is as mentioned above. As shown in FIG. 4, it was confirmed that the vibration level fell below the upper limit level in the whirl frequency band of 600 to 800 Hz with the cover of Example 1.

Figure 5:
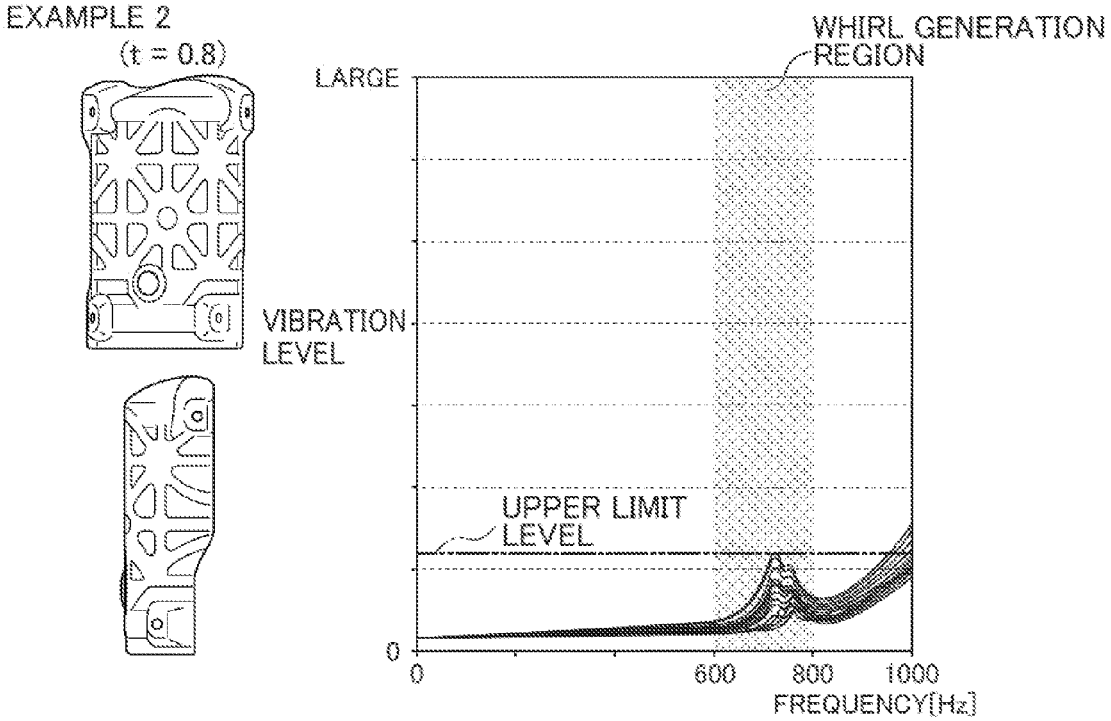
FIG. 5 is a view showing vibration analysis results by CAE of the cover of Example 2.
Figure 6:
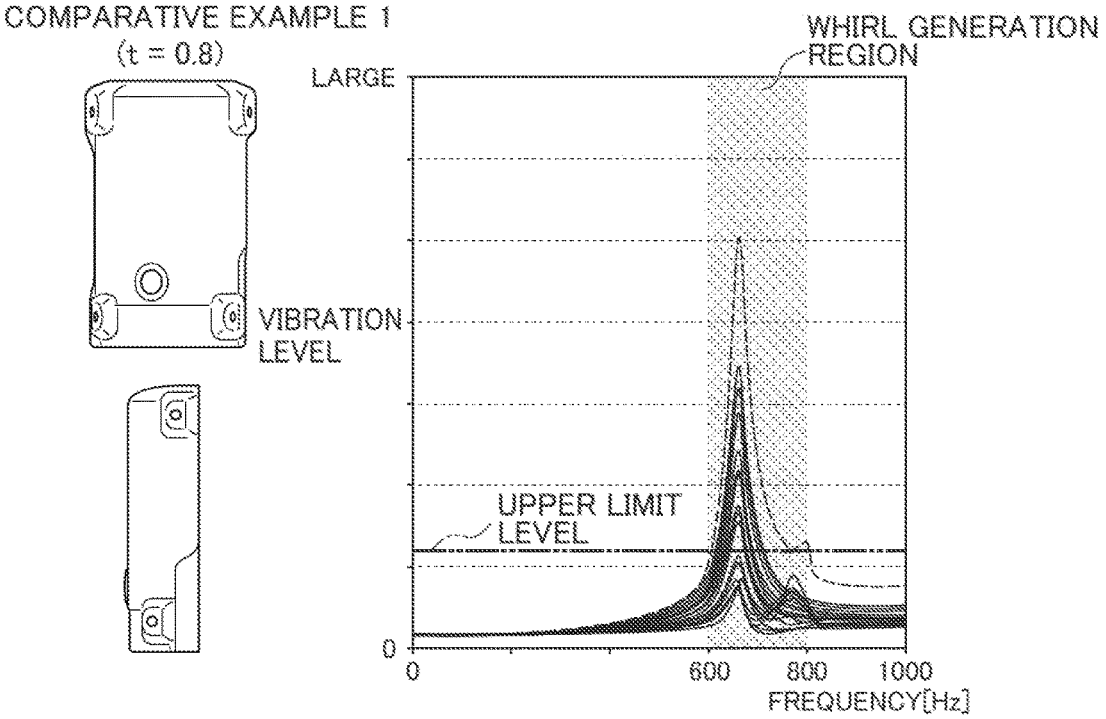
FIG. 6 is a view showing vibration analysis results by CAE of the cover of Comparative Example 1.
Figure 7:
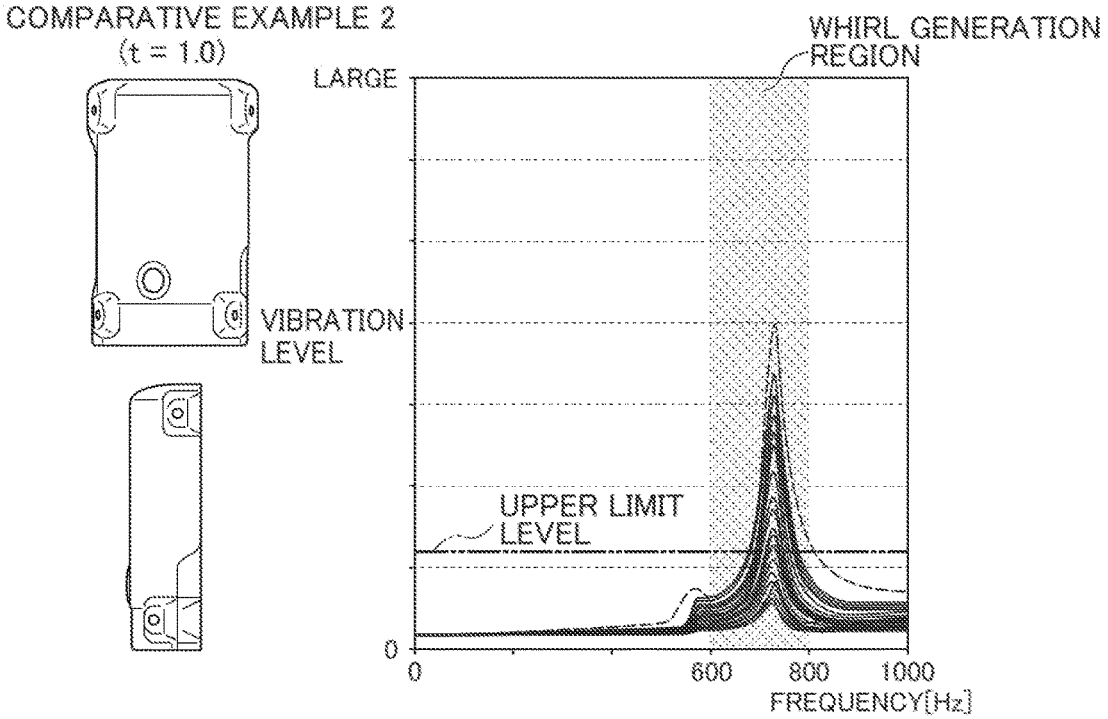
FIG. 7 is a view showing vibration analysis results by CAE of the cover of Comparative Example 2.
Figure 8:
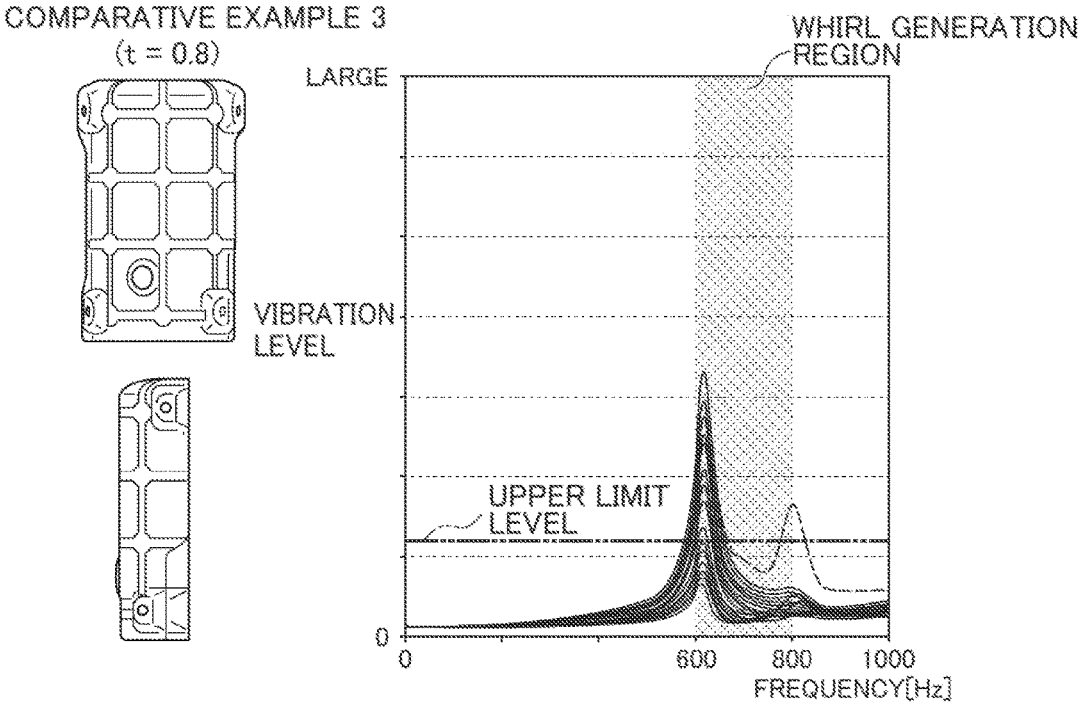
FIG. 8 is a view showing vibration analysis results by CAE of the cover of Comparative Example 3.
Figure 9:
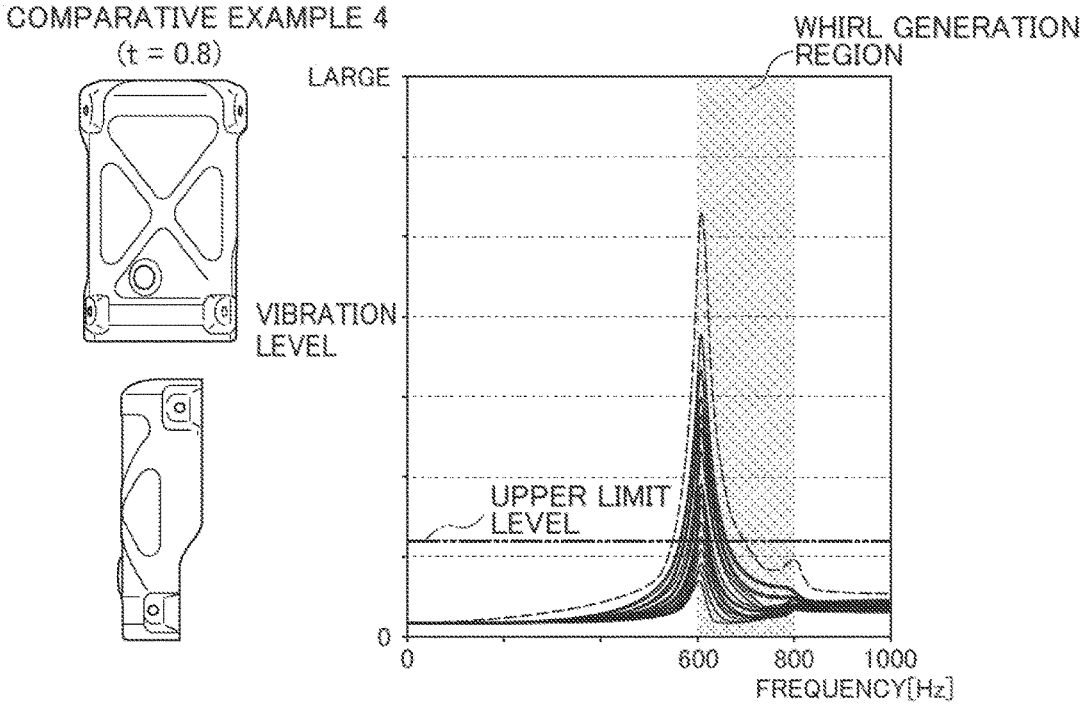
FIG. 9 is a view showing vibration analysis results by CAE of the cover of Comparative Example 4.
Figure 10:
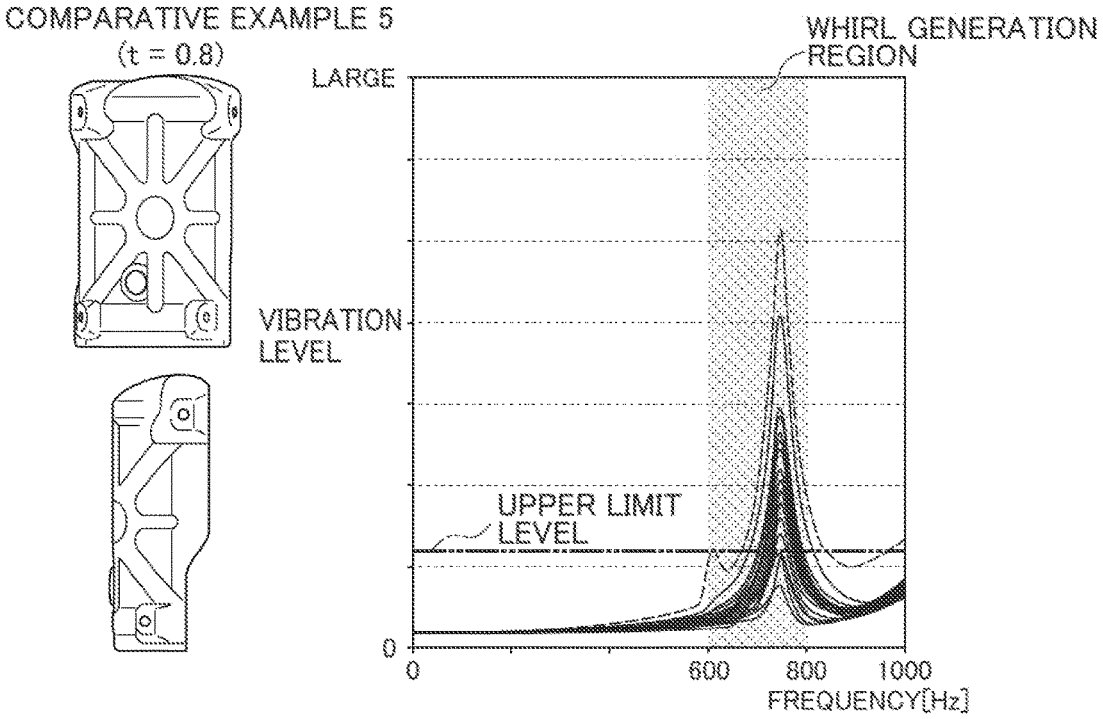
FIG. 10 is a view showing vibration analysis results by CAE of the cover of Comparative Example 5.
Figure 11:
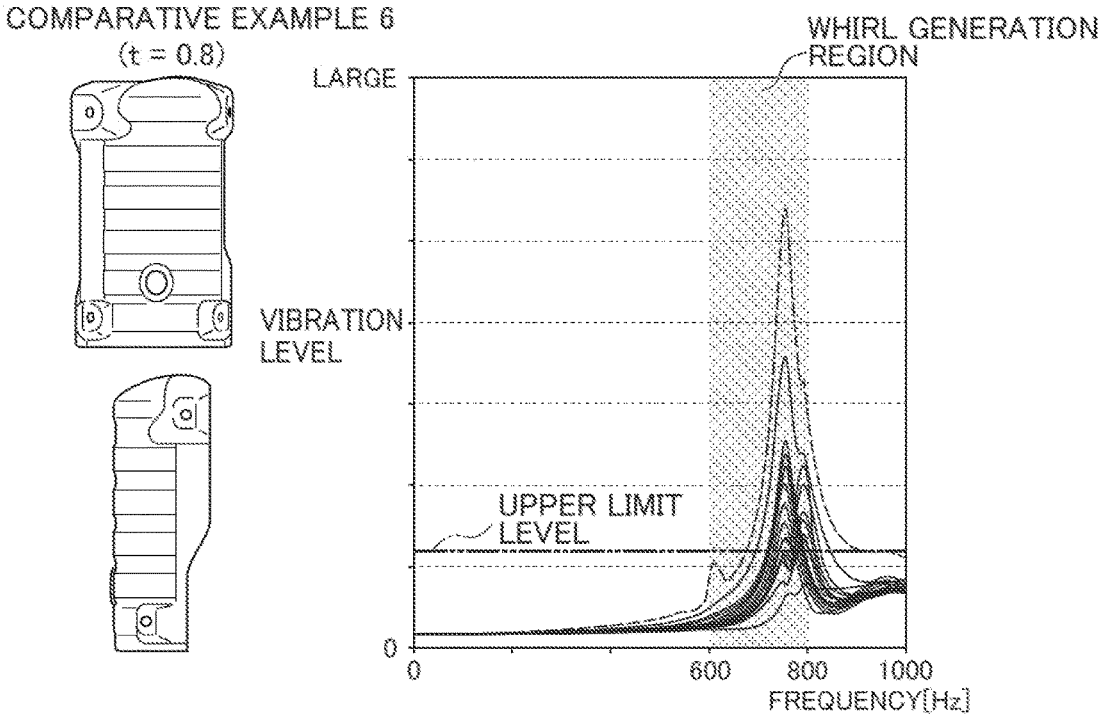
FIG. 11 is a view showing vibration analysis results by CAE of the cover of Comparative Example 6.
Figure 12:
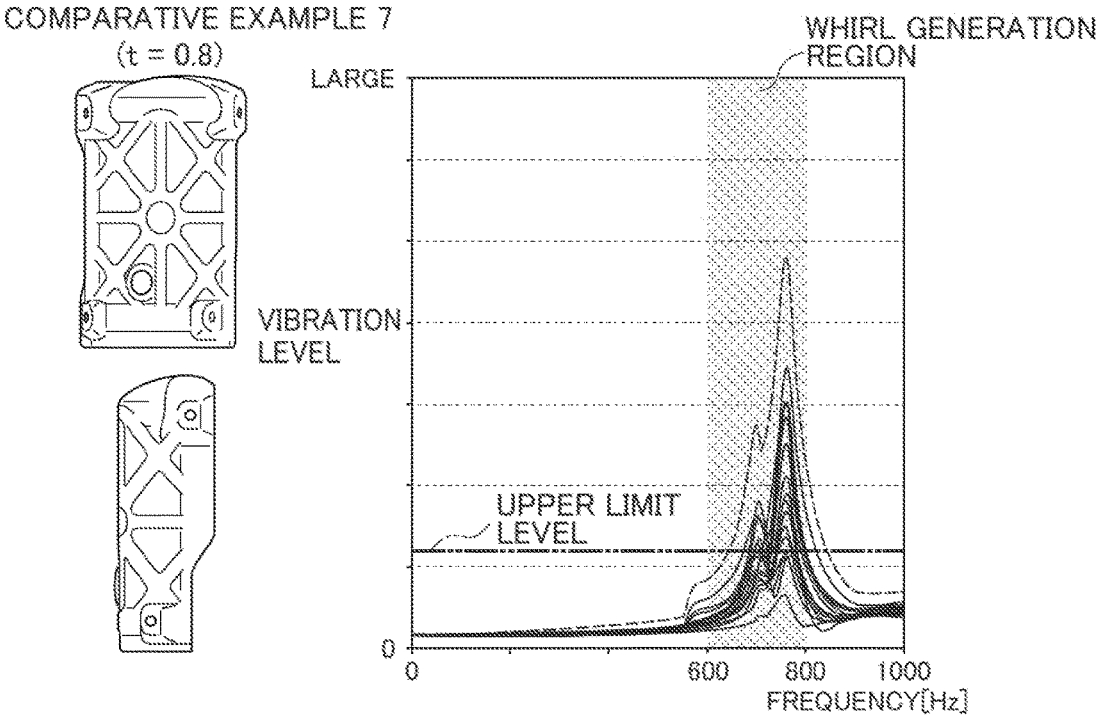
FIG. 12 is a view showing vibration analysis results by CAE of the cover of Comparative Example 7.
Figure 13:
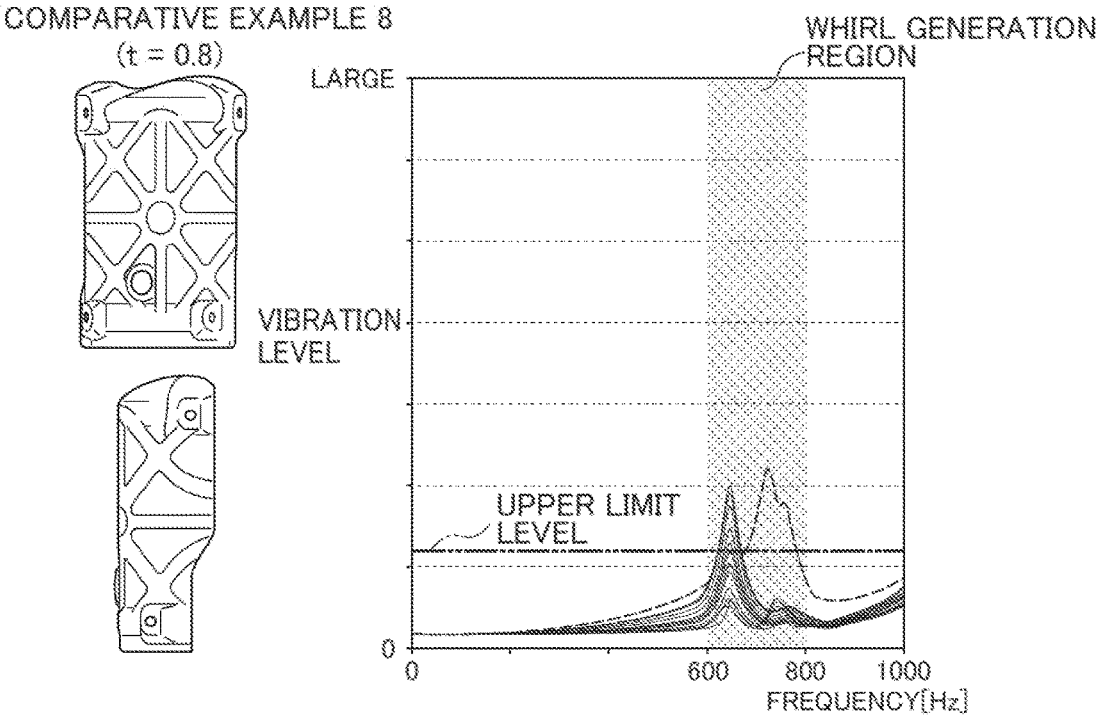
FIG. 13 is a view showing vibration analysis results by CAE of the cover of Comparative Example 8.

FIG. 5 is a view showing vibration analysis results by CAE of the cover of Example 2. The shape of the cover of Example 2 differs compared to Example 1 in the point of the circumferential ribs being a square shape, and the outer circumferential rib being a diamond shape. As shown in FIG. 5, it was confirmed that the vibration level fell below the upper limit level in the whirl frequency bank of 600 to 800 Hz with the cover of Example 2.

FIGS. 5 to 13 are views showing the vibration analysis results by CAE of each cover of Comparative Examples 1 to 8. The covers of Comparative Examples 1 and 2 have entirely no convex ribs, and the two only differ in thickness. The cover of Comparative Example 3 has convex ribs formed only in the longitudinal direction (vertical direction) and lateral direction (horizontal direction). The cover of Comparative Example 4 only has convex ribs extending in an oblique direction. The covers of Comparative Examples 5, 7 and 8 have radial ribs formed; however, circumferential ribs are not formed (interrupted midway). The cover of Comparative Example 6 has convex ribs formed only in the lateral direction (horizontal direction). As shown in FIGS. 6 to 13, it was confirmed that the vibration level exceeded the upper limit level in the whirl frequency band of 600 to 800 Hz for all of the covers of Comparative Examples 1 to 8, which are outside the scope of the present invention.

Noise Evaluation

Noise evaluation was conducted by equipping the exhaust-gas purification device including the cover of Example 1 to an engine bench equipped with a turbocharger. More specifically, operation was conducted with high-load operating conditions normally assumed, and the noise at this time was measured forward and above the engine. The results are shown in FIGS. 14 and 15.

Figure 14:
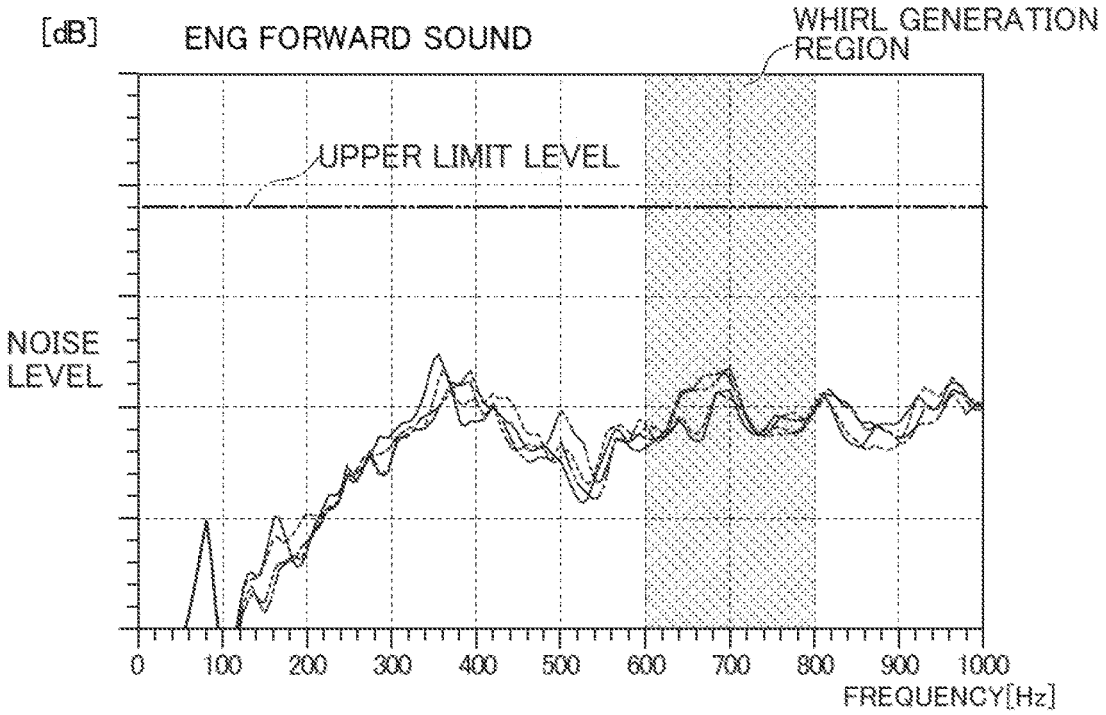
FIG. 14 is a view showing sound measurement results ahead of the engine of a vehicle equipped with the exhaust gas purification device including the cover of Example 1.
Figure 15:
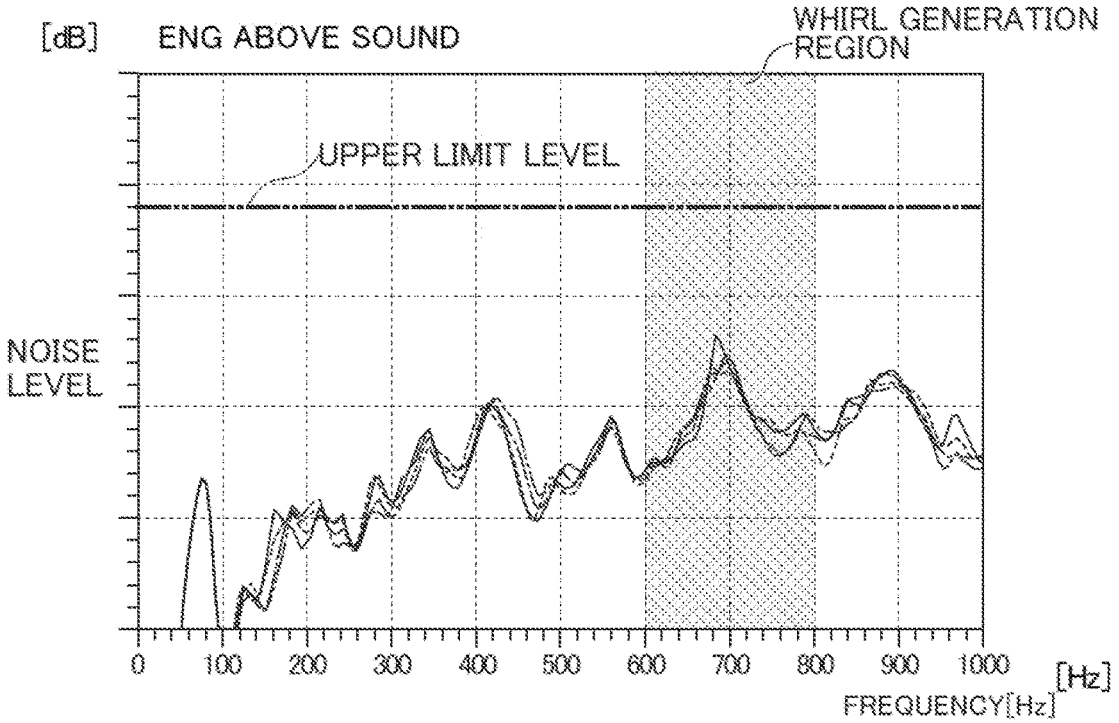
FIG. 15 is a view showing sound measurement results above the engine of a vehicle equipped with the exhaust gas purification device including the cover of Example 1.

FIG. 14 is a view showing noise measurement results forward of the engine of a vehicle equipped with the exhaust gas purification device including the cover of Example 1. FIG. 15 is a view showing noise measurement results above the engine of a vehicle equipped with the exhaust gas purification device including the cover of Example 1. Measurement was conducted with the n number as 4. As shown in FIGS. 14 and 15, it was confirmed that that noise level in the whirl frequency band of 600 to 800 Hz fell below the upper limit level for both forward noise and above noise of the engine. From these results, it was confirmed that it is possible to reduce whirl noise according to the cover shape of the present invention. In addition, in other frequency bands, it was confirmed that the noise level also fell below the upper limit level.

EXPLANATION OF REFERENCE NUMERALS

1 exhaust gas purification device
2 cover
8 turbocharger
9 exhaust pipe (exhaust channel)
10 exhaust gas purification device main body
20 convex rib
21 radial rib
21*a* top and bottom radial rib (radial rib)
21*b* left and right radial rib (radial rib)
21*c* right oblique radial rib (radial rib)
21*d* left oblique radial rib (radial rib)
22 circumferential rib
81 turbine
C central part
D diagonal line
X point of intersection

The invention claimed is:

1. An exhaust gas purification device for an internal combustion engine, the device comprising:

an exhaust gas purification device main body that is provided in an exhaust channel of the internal combustion engine, and purifies exhaust gas of the internal combustion engine; and a cover of quadrate shape that is provided so as to cover at least part of the exhaust gas purification device main body, and shields radiated heat from the exhaust gas purification device main body, wherein the cover has a plurality of convex ribs formed on the surface thereof, and wherein the ribs include a radial rib formed radially from a central part with a point of intersection of diagonal lines of the cover as the center, and a circumferential rib formed continuously over the entire circumference of a circle with the point of intersection as the center.

2. The exhaust gas purification device for an internal combustion engine according to claim 1, wherein a turbine of a turbocharger that compresses intake air using energy of exhaust gas is provided in the exhaust channel, and wherein the exhaust gas purification device main body is provided in a vicinity of the turbine.

3. The exhaust gas purification device for an internal combustion engine according to claim 1, wherein the central part is formed by a substantially even, flat surface.

4. The exhaust gas purification device for an internal combustion engine according to claim 2, wherein the central part is formed by a substantially even, flat surface.

* * * * *